United States Patent [19]

Kars

[11] Patent Number: 5,022,552

[45] Date of Patent: Jun. 11, 1991

[54] METHOD FOR PRODUCING OF A CLOSURE FOR A CONTAINER, CLOSURE, CONTAINER AS WELL AS THREADED RING

[75] Inventor: Herman P. Kars, Uithoorn, Netherlands

[73] Assignee: Koninklijke Emballage Industrie van Leer B.V., Amstelveen, Netherlands

[21] Appl. No.: 385,668

[22] Filed: Jul. 26, 1989

[30] Foreign Application Priority Data

Jul. 28, 1988 [NL] Netherlands ..... 8801900

[51] Int. Cl.[5] ..... B65D 41/04

[52] U.S. Cl. ..... 220/288; 220/DIG. 29

[58] Field of Search ..... 220/288, 304, DIG. 29; 219/121.63, 121.64

[56] References Cited

U.S. PATENT DOCUMENTS

| | | | |
|---|---|---|---|
| 1,709,324 | 4/1929 | Runser . | |
| 1,732,536 | 10/1929 | Rieke . | |
| 2,008,245 | 7/1935 | Curtis et al. | 220/288 X |
| 2,263,740 | 11/1941 | Sample | 219/4 |
| 2,306,180 | 11/1942 | Myers et al. | 285/49 |
| 2,308,089 | 1/1943 | McClary | 220/288 X |
| 2,397,440 | 3/1946 | Schwartz | 220/288 |
| 2,916,311 | 12/1959 | Keplinger | 220/288 X |
| 3,179,280 | 4/1965 | Littefield | 220/288 |
| 3,958,719 | 5/1976 | Ward | 220/288 |
| 4,189,824 | 2/1980 | Dillon et al. | 29/522 R |
| 4,642,446 | 2/1987 | Pennington | 219/121.64 |
| 4,737,612 | 4/1988 | Bruck et al. | 219/121.64 |
| 4,758,704 | 7/1988 | Kogel | 219/121.64 |

FOREIGN PATENT DOCUMENTS

| | | |
|---|---|---|
| 7500967 | 5/1975 | Fed. Rep. of Germany . |
| 2535083 | 2/1977 | Fed. Rep. of Germany . |
| 0025353 | 5/1931 | Netherlands . |
| 7600353 | 1/1975 | Netherlands . |
| 7600979 | 1/1976 | Netherlands . |
| 0156773 | 2/1922 | United Kingdom . |
| 0321472 | 11/1929 | United Kingdom . |
| 0704514 | 2/1954 | United Kingdom . |

*Primary Examiner*—Stephen Marcus
*Assistant Examiner*—Nova Stucker
*Attorney, Agent, or Firm*—Brumbaugh, Graves, Donohue & Raymond

[57] ABSTRACT

Method for preparing a closure of a container. The container is provided with an outwardly directed collar wherein a threaded ring is placed. After position of the threaded ring this is welded to the free edge of the collar.

1 Claim, 1 Drawing Sheet

METHOD FOR PRODUCING OF A CLOSURE FOR A CONTAINER, CLOSURE, CONTAINER AS WELL AS THREADED RING

DESCRIPTION

This invention relates to a method for producing of a closure, comprising a threaded ring and container part, wherein the threaded ring is positioned in use projecting outwardly relative to the surface of the container, wherein in the container a collar is realized projecting outwardly in the position of use, a threaded ring is provided, which can be received in the collar and wherein after inserting of the threated ring, this is connected to the collar away from the container.

This method is known from NL-A-7600979. The threaded ring is there connected to the projecting collar by multiple flanging. To prevent rotating of the threaded ring relative to the collar, the threaded ring is shaped at its upper side polygonally engaging the corresponding polygonally shaped end part of the collar. Such a closure is designed for relatively light duty vessels. Inherently to the method of securing and connecting a relatively large difference exists between the external diameter and the internal diameter of the closure. Because of this the closure is not within the range of international standards for applying of fill and discharge devices. Based on the polygonal shape of the upper side of the threaded-shaped ring, the thread proper can only start at some distance from the extremity. This has as drawback that the thread extends over a considerable distance inside of the container. Except from the relatively large quantity of material being necessary for shaping of the threaded ring, also openings have to be provided to be able to fully empty the container. If such a flange connection is subjected to elevated temperatures, proceding properties of such a connection cannot further be guaranteed. Subjecting to elevated temperatures is in particular of importance during cleaning of vessels before re-use. Because of the relatively light quality of the container according to the Netherlands patent application such containers are not suitable for repeated use. Furthermore the containers according to the Netherlands patent specification is not able to successfully come through the international standarised drop tests. After dropping on the collar end the polygonal will distorted such that no engagement is provided between the threaded ring and the collar, such that it is not possible any longer to normally open the vessel.

The subject invention aims to obviate these drawbacks.

This aim is realized with the method described above in that the connection comprises welding. It was found that the welding connection is many times stronger than the flange connection, such that it is not necessary to provide further securing such as a polygon. Nevertheless it became clear after drop tests that the welded connection between the threaded ring and the collar end does not fail even if large monentums are applied (such as 100 kgm). As the threaded ring can remain circular at its upper side, the thread itself can directly start at the outer boundary, which on the one hand gives a material saving and makes it on the other hand possible to make the lower side of the threaded ring flush with the upperside of the container, such that it is not necessary to provide extra bores. The welded connection can be realized in such a limited space that the difference between internal and external diameter of the closure is within the international standards, such that it is possible to apply all usual fill and discharge fittings known in the prior art. By using of welding also during high temperature treatment of the container this connection will not deterioriate.

It is remarked that from DE-U-7500967 a welded connection is known between a container and a threaded ring, wherein however the container is not provided with a collar part, such as with the subject invention, but the threaded ring is directly welded to the container. This closure has as drawback that during dropping the threaded ring is not protected by the collar as with the subject invention, such that relatively easy distortion to the threaded ring occurs, such that after dropping of the vessel it is not possible to remove the plug. Furthermore it is nevertheless necessary to subject the container near the area which has to be connected to the threaded ring to special shaping to realize centering of the threaded ring with regard to the container. It is also necessary to precisely finish the end of the threaded ring to be welded, because there is only a small tolerance with regard to the position of the welding seam.

According to an advantageous embodiment of the method the connection between the threaded ring and the collar is realized by laser welding. It is possible with laser welding to exactly determine the spot of the weld by focussing of the laser beam, such that it can be prevented that a sealing face for the plug to be inserted later is within the heat affected zone, such that later finishing is not necessary.

The invention also relates to a closure for a container comprising a container having a collar being directed outwardly in its position of use and having therein a threaded ring, wherein between the threaded ring and the collar near the container a space is provided and the threaded ring is connected to the collar end away from the container by welding.

The free end of the collar part is preferably doubled, such that a rounding is realized at least partially coinciding with the rounding of the threaded ring, such that centering and connection of the threaded ring with regard to the collar part is optimized.

The invention will be further elucidated referring to embodiments shown in the drawings wherein.

Figure 1:
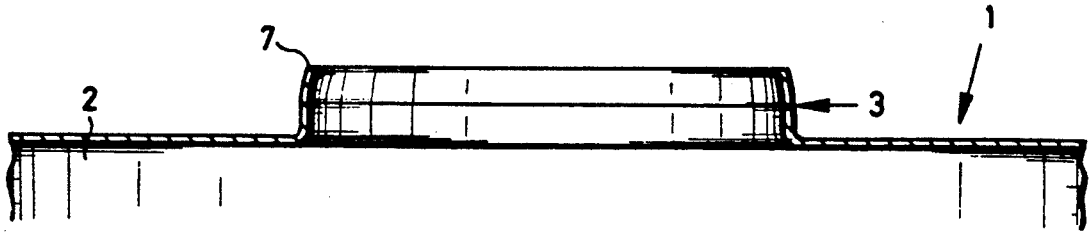
FIG. 1 shows a diagrammatically side view in cross section of a container provided with a collar.

In FIG. 1 a container is generally indicated with 1. The interior of the container is indicated with 2. Projection from the container collar 3 is provided.

Figure 2:
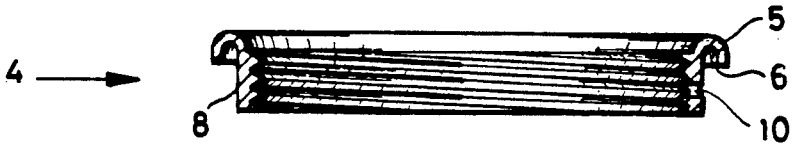
FIG. 2 shows schematically in cross section a threaded ring.

In FIG. 2 a threaded ring is shown, generally indicated with 4 provided with beaded edge 5. This edge is not completely beaded but a gap 6 exists being as wide or wider than the thickness of the upper part 7 of the collar. In the embodiment shown the casing 8 of the threaded ring is cylindrical whilst collar 3 slightly tapers outwardly.

Figure 3:
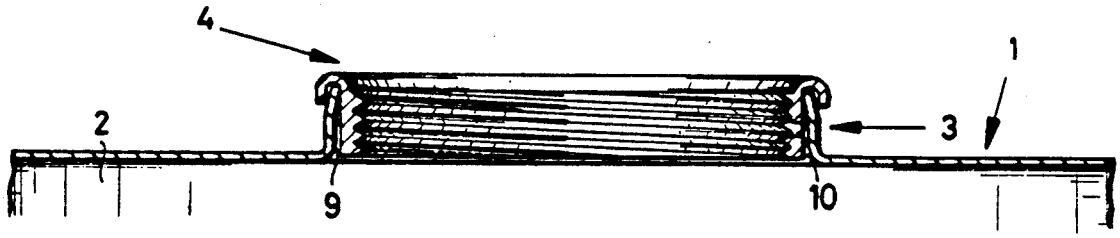
FIG. 3 shows the threaded ring positioned on the container.

In FIG. 3 the situation is shown after providing of the threaded ring 4 in container 1. From this it is clear that the connection is at the upper side of collar 3. If the container 1 drops on the threaded ring 4, this will together with collar 3 move inwardly. During this collar 3 deforms considerable and threaded ring 4 does not deform. This in contrast to the prior art wherein the protection of collar 3 for ring 4 is not present. Also at the internal side 2 between threaded ring 4 and collar 3 a space 9 is provided. Because of this space the threaded ring 4 can deflect within collar 3 if beaded edge 5 or a plug inserted therein is hit, without fear for damage to the thread. The connection between threaded ring 4 and collar 3 is realized near beaded edge 5 and the upper side of collar 7.

This connection can be realized with all welding technics known in the art such as friction welding and roll welding.

However, preferably laser welding is used, because it is possible to heat a very small strip of material, such that the heat affected zone is relatively limited and the sealing surface of the threaded ring has not to be further finished. Furthermore it is now possible to exactly determine the position of the weld by focussing the laser beam to a determined point. By later providing of the threaded ring with beaded edge 5 it is possible to first provide a so called label ring. Furthermore standard parts as used with pressed closures can be used. Using welding all around it is not necessary to use a sealing ring, which is more particular of importance if the vessel has to be used several times.

Figure 4:
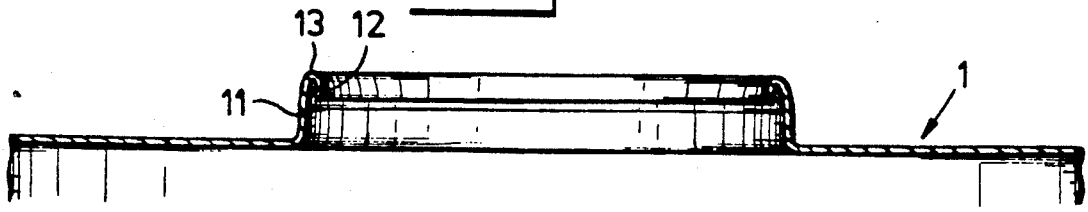
FIG. 4 shows a further embodiment of the collar.

In FIG. 4 a further embodiment of the collar is shown generally indicated with 11. In contrast to the first embodiment the free end is doubled with edge 12. Because of this rounding 13 is realized which at least corresponds with rounding a gap 6 of threated ring 4. In this way better centering and better connection of threaded ring to the collar is obtained.

Although the embodiments described here are preferred, it has to be understood that many variations can be made without leaving the range of the subject invention. So it is possible that the collar is cylindrical and the threaded ring tapers and/or a combination of both. It is only of importance that at the collar end away from the container the connection between the threaded ring and the collar part is realized by welding.

I claim:

1. A plug opening construction for a container comprising a circular cylindrical collar integral with and of the same thickness as the container material extending outwardly from a surface of said container, said collar having a circular outer end surface and being tapered outwardly therefrom toward said surface of the container, and an internally threaded plug-receiving ring formed of material thicker than the container material assembled within said collar, said ring having an integral circumferential bead extending laterally beyond and downwardly around the outer surface of said collar for forming a circumferential groove at least as wide as the thickness of the collar material in which the outer end surface of said collar is received for supporting said ring on said collar, the outer surface of said ring being untapered and with the inner surface of said collar defining a tapered annular space between said ring and said collar, said bead being laser welded to said collar only along said outer end surface of said collar, the location of said weld in cooperation with said tapered annular space providing for flexibility against breakage of said collar and ring in the event of impact.

* * * * *